US005508892A

United States Patent [19]

Laczynski et al.

[11] Patent Number: 5,508,892

[45] Date of Patent: Apr. 16, 1996

[54] LIGHT PROCESSING APPARATUS FOR CREATING VISUAL EFFECTS

[75] Inventors: Andrew J. Laczynski; James S. Angus, both of Toronto, Canada

[73] Assignee: H Space Technologies, Inc., Toronto, Canada

[21] Appl. No.: 79,585

[22] Filed: Jun. 22, 1993

[51] Int. Cl.[6] ..... F21V 7/04

[52] U.S. Cl. ..... 362/32; 362/293; 362/319; 362/802; 385/901; 385/115; 359/889; 40/547

[58] Field of Search ..... 362/32, 31, 26, 362/293, 802, 281, 319, 311; 385/31, 115, 116, 121, 901; 359/885, 889; 40/570, 547

[56] References Cited

U.S. PATENT DOCUMENTS

| | | | |
|---|---|---|---|
| 3,184,872 | 5/1965 | Way | 40/547 |
| 3,803,398 | 4/1974 | Walker | 362/32 |
| 3,836,911 | 9/1974 | Gibson et al. | 40/547 |
| 3,912,361 | 10/1975 | Bentley | 385/115 |
| 3,962,702 | 6/1976 | Kriege | 385/901 |
| 4,212,516 | 7/1980 | Sawamura | 385/115 |
| 4,745,525 | 5/1988 | Sheehy | 362/32 |
| 4,747,648 | 5/1988 | Gilliland, III | 362/32 |
| 4,800,474 | 1/1989 | Bornhorst | 359/889 |
| 4,807,092 | 2/1989 | Hasegawa | 362/32 |
| 4,917,448 | 4/1990 | Oppenheimer | 362/32 |
| 5,053,765 | 10/1991 | Sonehara et al. | 362/32 |
| 5,150,445 | 9/1992 | Toyoda et al. | 385/116 |
| 5,184,253 | 2/1993 | Hwang | 359/889 |
| 5,247,600 | 9/1993 | Williams et al. | 40/547 |

*Primary Examiner*—James C. Yeung
*Attorney, Agent, or Firm*—Bereskin & Parr

[57] ABSTRACT

Light processing apparatus creates visual effects with light from a light source. An input bundle of flexible fibre optic light guides receives light from the light source. A reconfiguration plate reconfigures the output ends of the light guides into a plurality of separated input zones of selected shape. A filter having colored areas shaped to correlate with the input zones filters the light. An output bundle of flexible fibre optic light guides distributes the light transmitted through the filter. A configuring plate configures the input ends of the output bundle of light guides into output zones which correlate with the input zones. The filter may be a rotatable color wheel or a computer-controlled liquid crystal display. When the filter is activated, the colored areas change colors, thereby creating various visual effects, such as painting with light. The light processing apparatus can be incorporated into a sign or other lighting product having a display panel or other device for displaying the visual effects.

20 Claims, 5 Drawing Sheets

LIGHT PROCESSING APPARATUS FOR CREATING VISUAL EFFECTS

BACKGROUND OF THE INVENTION

The present invention relates to light processing apparatus for creating visual effects with light from a light source, and to signs, display panels and other lighting products utilizing such processing apparatus.

Various conventional decorative or display lighting devices utilize fibre optics or light guides. Typically, white light from a light source is passed through a colour wheel onto the circular common end of a harness of fibre optic light guides. The output ends or "tails" of the fibre optic light guides are then positioned on a display surface such as a sign in a pre-selected pattern to create a desired visual effect. The colour wheel may be rotated through a sequence of colours so as to create an end effect which simulates movement and flow.

Existing decorative lighting devices suffer from a number of drawbacks, including uneven illumination. When the colour wheel is rotated, a colour front initially illuminates only a few of the light fibres situated at the edge of the common end. As the colour front moves across the surface of the common end, an increasing number of light fibres are illuminated, but as the colour wheel continues its movement, fewer light fibres are illuminated. The net result is disproportionate illumination and uneven colour flow. Another problem with conventional lighting systems is the risk of heat damage to colour wheels caused by high intensity focused light, including discoloration, distortion and disintegration. This problem can be avoided by using colour wheels made from relatively robust and expensive materials such as glass, but glass colour wheels are heavy and require larger drive motors. Standard colour wheels are also incapable of utilizing the full spectrum of colour combinations. Furthermore, conventional systems are inefficient in that they do not facilitate the sequencing of fibre optic strands into pre-determined positions to create a desired end effect.

There is accordingly a need for a low cost light processing system which overcomes the problems associated with the prior art.

SUMMARY OF THE INVENTION

The present invention is directed to light processing apparatus for creating visual effects with light from a light source. The subject light processing apparatus comprises input light distribution means for distributing light from the light source into a plurality of input light paths, having input ends for receiving light from the light source and output ends, input light path reconfiguring means for reconfiguring the output ends of the input distribution means into a plurality of separated input zones of selected shape, filtering means for filtering the light emitted from the output ends of the input distribution means having filtering areas shaped to correlate with the input zones for transmitting light of pre-selected colours, filtered light distribution means for distributing the light transmitted through the filtering means into a plurality of output light paths, having input ends and output ends, and filtered light configuring means for configuring the input ends of the filtered light distribution means into output zones shaped to correlate with the input zones.

In a preferred embodiment, the subject processing apparatus comprises light distribution means for distributing flight from the light source into a multiplicity of light paths, comprising an input bundle of flexible fibre optic light guides having optically finished input ends for receiving light from the light source and optically finished output ends, input light path reconfiguring means for reconfiguring the output ends of the light guides into a plurality of separated input zones of selected shape, filtering means for filtering the light being emitted from the output ends of the input bundle of light guides having filtering areas to correlate with the input zones adapted to transmit light of pre-selected colours, filtered light distribution means for distributing the light transmitted through the filter means, comprising an output bundle of flexible fibre optic light guides having optically finished input and output ends, and filtered light path configuring means for configuring the input ends of the second bundle of light guides into output zones shaped to correlate with the input zones.

The input zones may comprise a series of concentric arcuate paths. The filtering means may comprise a rotatable circular colour wheel having coloured annular sectors, each of which is adapted to overlap respective arcuate paths on the input light point configuring means. The output zones of the filtered light path configuring means are preferably shaped to be mirror images of the concentric arcuate input zones.

Alternatively, the filtering means may be a computer-controlled active filter comprising a liquid crystal matrix having a series of filtering zones which change colour when the filter is activated. In this embodiment, the input and output zones comprise a series of paths which correlate with the filtering zones.

The subject light processing system may be incorporated into the housing of a display sign which includes display means for receiving the output ends of the output bundle of light guides in a pre-selected pattern. Pre-determined visual effects are displayed on the display means when the filter is activated.

The light processing apparatus of the present invention may also be utilized in a number of applications, including decorative signs, spot lights, directional panels such as those which display arrows and like moving symbols, information panels such as an interactive map showing bus stop locations, and other lighting products.

BRIEF DESCRIPTION OF THE DRAWINGS

The invention will now be described with reference to the accompanying drawings, in which.

BRIEF DESCRIPTION OF THE PREFERRED EMBODIMENTS

Figure 1:
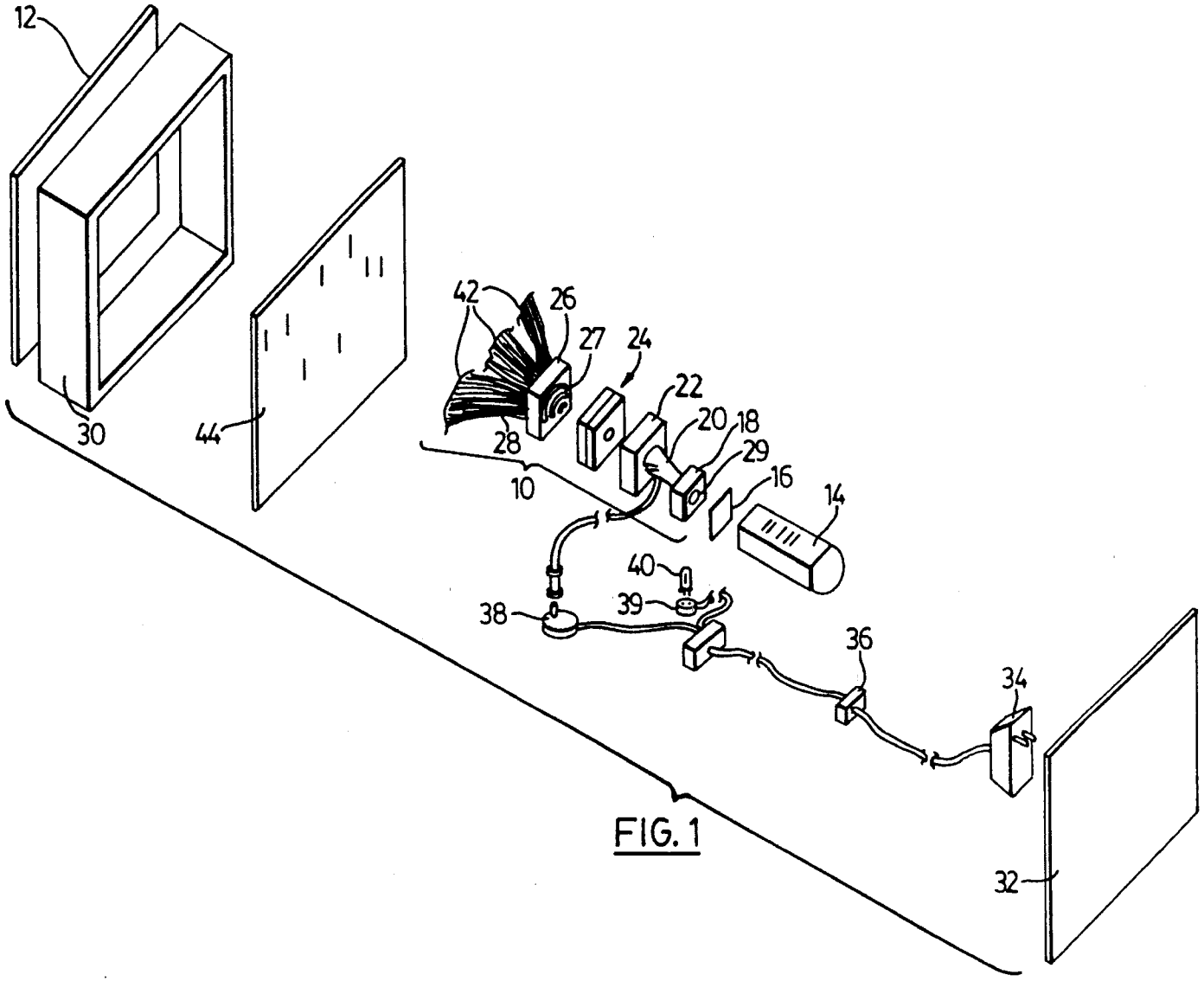
FIG. 1 is an exploded diagrammatic view of the light processing apparatus of the subject invention.

FIG. 1 illustrates in a diagrammatic fashion the main elements of the light processing or management apparatus of the subject invention, shown generally as 10. Light processing apparatus 10 is used to generate visual effects on a sign front or display panel 12, with light from a light source 14, preferably focused into a circular pattern by lens 16. Processing apparatus 10 comprises common end plate 18, input bundle or harness of fibre optic light guides 20, input light path reconfiguration plate 22, colour filter assembly 24, output light path configuration plate 26, and output bundle or harness of fibre optic light guides 28.

Common end plate 18 preferably has a large, central circular aperture for holding the input ends of input bundle of light guides 20, so as to form common end 29 which receives light from light source 14. Alternatively, common end plate aperture could be square or rectangular, depending on the geometry of the light beam created by light source 14. Output light path configuration plate 26 has a series of slots 27 for holding the input ends of output bundle of light guides 28. Input light path reconfiguration plate 22 has a similar series of slots, which are preferably mirror-images of slots 27, for holding the output ends of input bundle of light guides 20. As shown in FIG. 1, slots 27 are arcuate or curved, so as to be used in conjunction with an active filter assembly comprising a rotatable colour wheel having circular geometry. Alternatively, filter assembly could be a computer-controlled active filter comprising liquid crystal screen having coloured areas, as discussed in more detail hereinbelow, in which case slots 27 may not be curved.

Processing apparatus 10 may be incorporated into a sign or other display means by mounting it within housing 30 between display panel 12 and sign back 32. The sign preferably includes transformer 34, terminal block 36, AC or DC motor 38 for activating colour filter assembly 24, and a lamp socket 39 for holding light 40. Output or effect ends 42 of guides 28 are mounted onto intermediate support panel 44.

Input and output bundles of fibre optic light guides 20, 28 are preferably low-cost plastic (polymethyl methacrylate) fibres, although they may be glass (silica) fibres. The input and output ends of both bundles of light guides 20, 28 are highly polished or otherwise optically finished to an optical quality standard so that maximum light transmission is achieved.

Light emitted from light source 14 is focused by lens 16 onto circular common end 29. Input bundle of light guides 20 distributes this light into a multiplicity of light paths separated into a plurality of input zones created by the output ends of the light guides held in the series of slots in input configuration plate 22. The light transmitted through these input zones is then filtered by colour filter assembly 24, and is received by corresponding output zones created by the input ends of the output bundle of light guides 28 held in slots 27 in output configuration plate 26. The light is then distributed by the output ends or "tails" 42 of light guide bundle 28 to pre-selected locations on support panel 44, so as to illuminate selected translucent areas of display panel 12. Special effects simulating movement and flow are created when colour filter 24 is activated.

Figure 2:
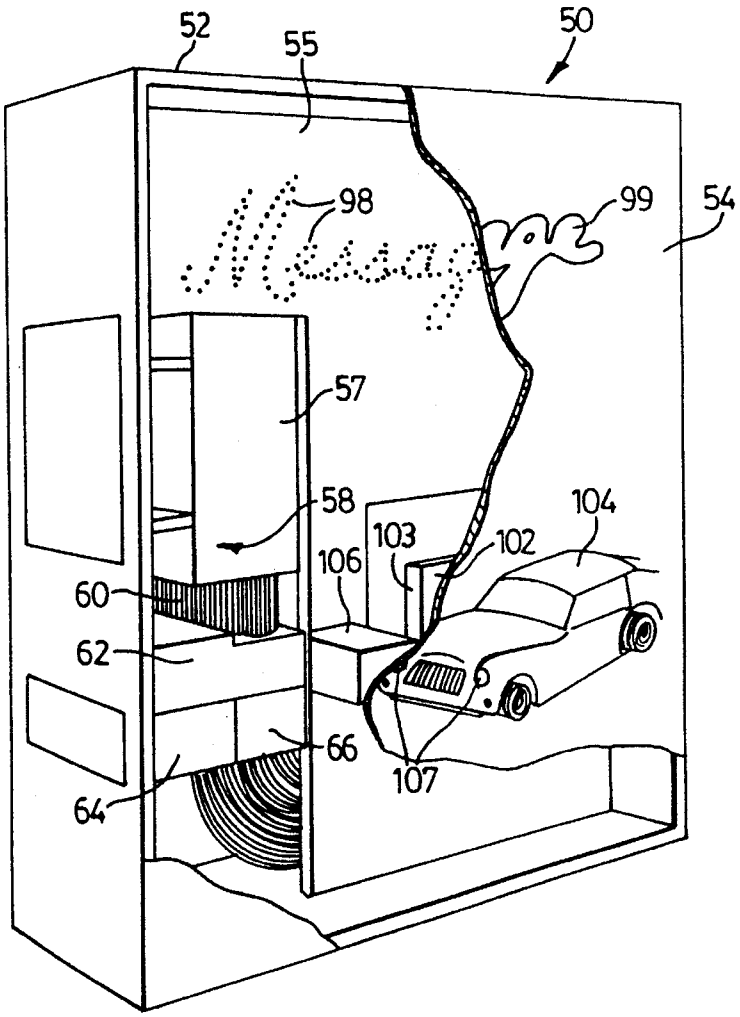
FIG. 2 is a perspective view of a sign embodying a preferred embodiment of the subject light processing apparatus, with the front panel partially broken away.
Figure 3:
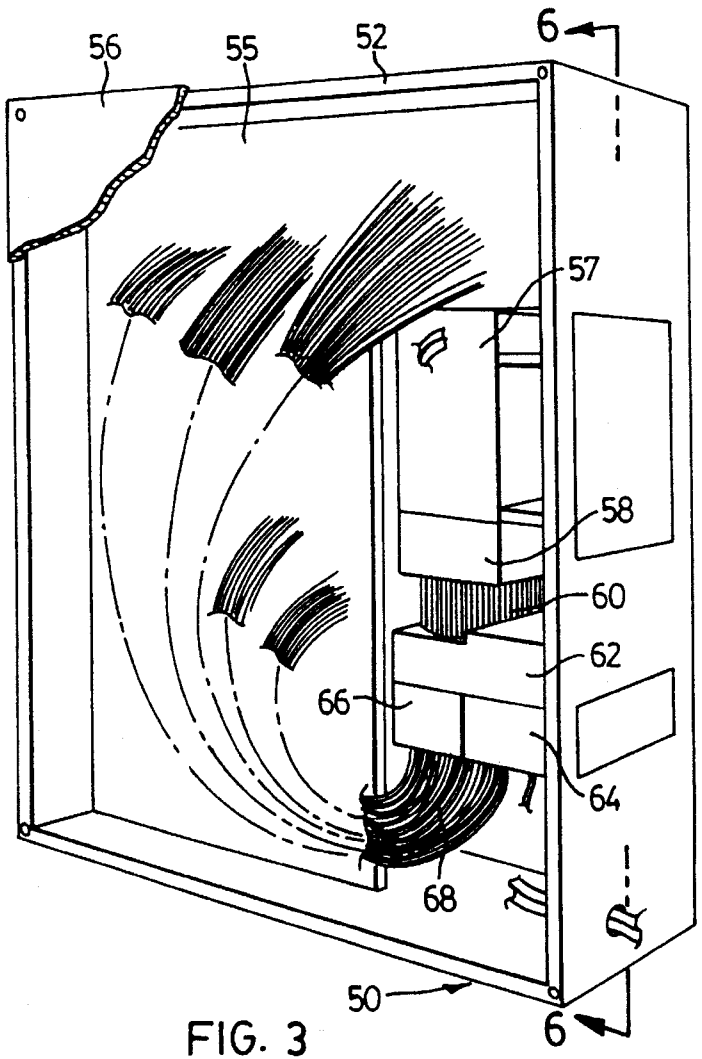
FIG. 3 is a perspective view of the back of the sign shown in FIG. 2, with the back panel mostly broken away.

FIGS. 2–9 illustrate a visual effects sign 50 embodying a preferred embodiment of the light processing apparatus of the subject invention. As shown in FIG. 2 and FIG. 3, sign 50 comprises housing 52, front effect panel 54, intermediate support panel 55, back panel 56, light source 57, common end plate 58, input bundle of light guides 60, input light path reconfiguration plate 62, colour wheel assembly 64, output light path configuration light 66, and output bundle of light guides 68.

Figures 4, 5:
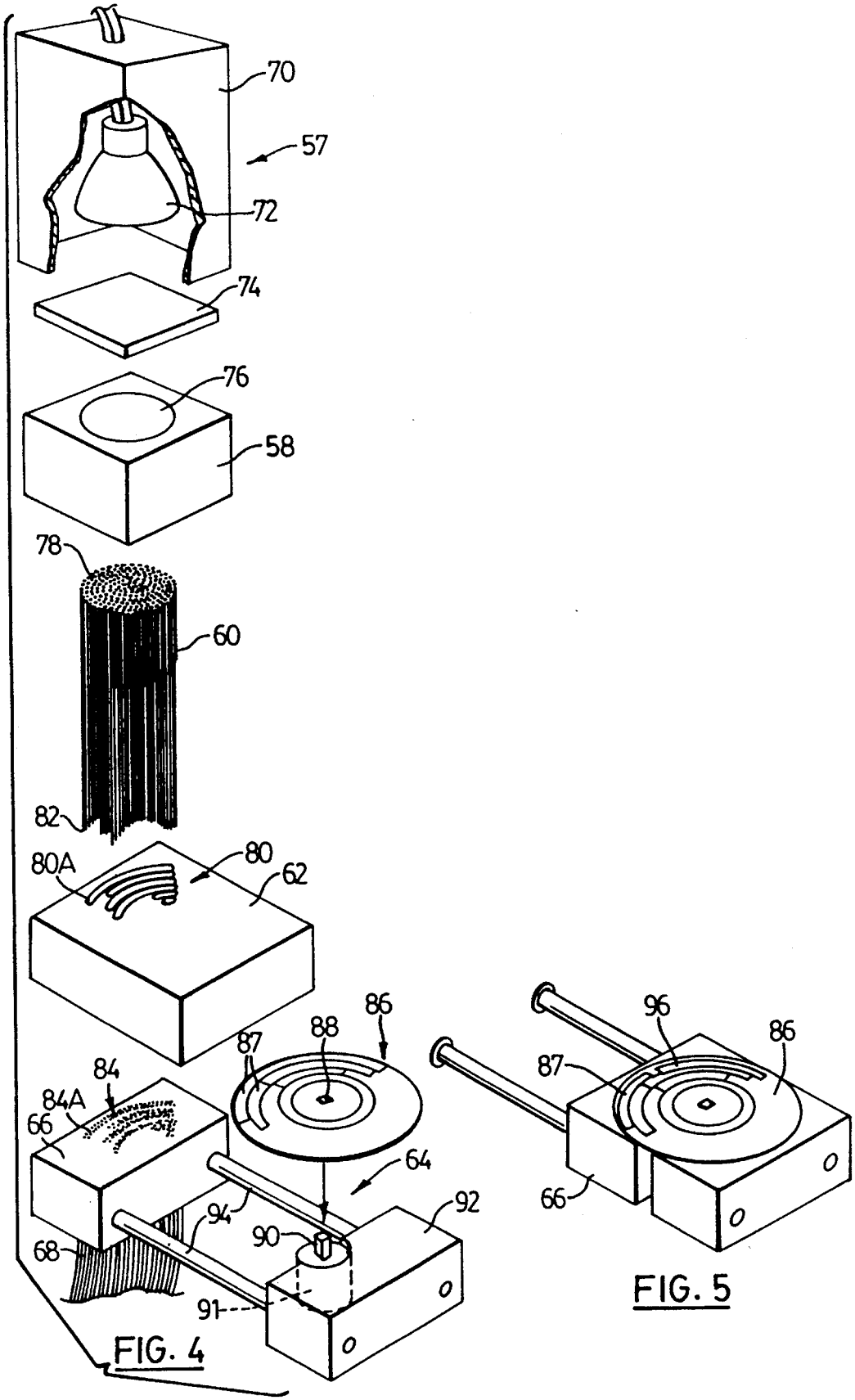
FIG. 4 is an exploded perspective view of the components of the preferred embodiment of the subject light processing apparatus.
FIG. 5 is a perspective view of the colour wheel assembly of the subject processing apparatus shown in its operating position.

FIG. 4 is an exploded perspective view of the subject light processing apparatus comprising common end plate 58, input bundle of light guides 60, input light path reconfiguration plate 62, colour wheel assembly shown generally as 64, output light path configuration plate 66, and output bundle of light guides 68. Light source 57 includes light housing 70 having mounted therein light bulb 72 and lens 74.

Common end plate 58 has circular aperture 76 for holding input ends 78 of input bundle of light guides 60. Input light path reconfiguration plate 62 has a series of arcuate slots 80 for receiving the output ends 82 of input bundle of light guides 60. Output light path configuration plate 66 has a series of arcuate slots 84, which are mirror-images of slots 80, for receiving the input ends of output bundle of light guides 68. The ends of the light guides are cut flush with the surfaces of plates 62, 66 and highly polished to an optical standard.

Plates 62, 66 are preferably blocks of brass, polyethylene or similar material, depending upon the nature of the fibre optics used for light guides 60, 68. Slots 80, 84 are preferably in the shape of a section of an annulus or ring. The width and length of slots 80, 84 are selected depending upon the desired end effect to be created. Most end effects will require their own slot, although it is possible to create more than one separate visual effect with the same slot by appropriate positioning of the tails of the light fibres held in such slot.

Colour wheel assembly 64 comprises colour wheel 86 having a square central aperture 88 sized to fit square boss 90 on the drive shaft of motor 91 mounted on block 92. A pair of spaced rails 94 extend laterally from block 92 and are slidably received in apertures in output light path configuration plate 66. In FIG. 4, block 92 is shown in its extended position, allowing for colour wheel 86 to be conveniently removed from drive shaft 90. In FIG. 5, block 92 is shown in its operating position in which colour wheel 86 is shown in place covering arcuate slots 84 of plate 66. Alternatively, the colour wheel assembly could be fixed in place or mounted on a hinged block which would allow the colour wheel to be removed conveniently by swinging the front portion of the block outwardly.

Figure 6:
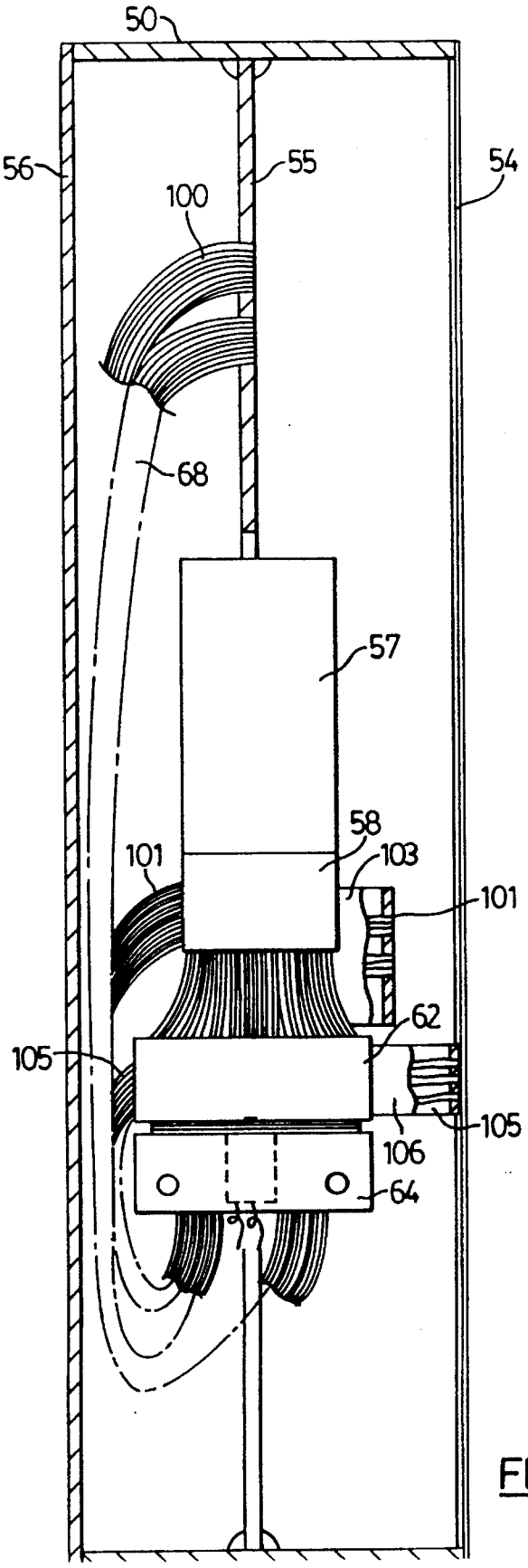
FIG. 6 is sectional view taken along lines 6–6 in FIG. 3.

Referring to FIG. 6 and FIG. 2, mounted within housing 50 is an intermediate support panel 55, for supporting the various components of the subject decorative lighting control apparatus. Support panel 55 also holds the output ends or "tails" of the light fibres contained in output bundle of light guides 68. The tails of some light fibres 100 may be mounted directly in apertures 98 in support panel 55 to form the letters of the "Message" 99 shown in FIG. 2. Other light fibres 101 may be mounted in apertures 102 in block 103 mounted onto the front surface of support panel 55 to bring the tails of fibres 101 closer to the translucent design such as the representation of an automobile 104 on the front surface 54 of sign 50. Still other light fibres 105 are mounted on thicker block 106 secured to support panel 55 to create a brighter visual effect such as the headlight 107 of automobile 104.

Figure 7:
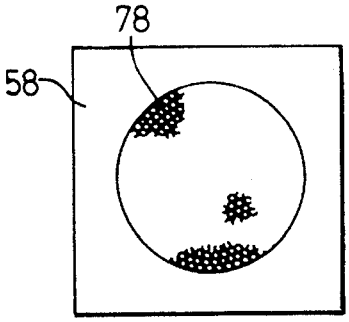
FIGS. 7, 8 and 9 are plan views of components of the preferred embodiment of the subject apparatus.
Figure 8:
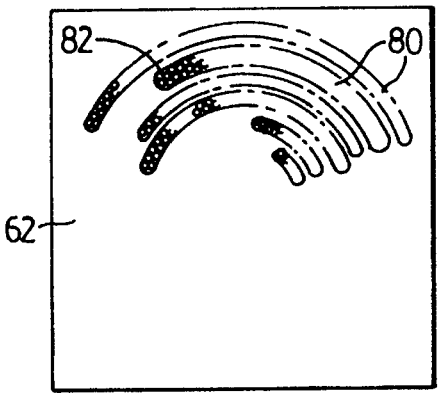
Figure 9:
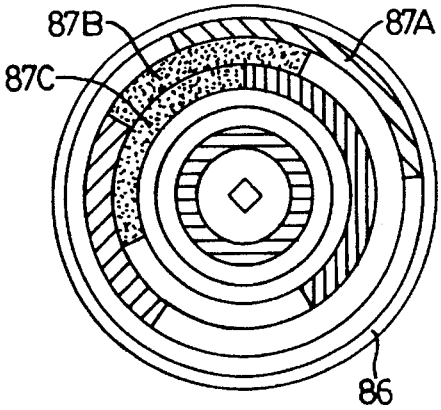

Referring now to FIGS. 7 and 8, shown therein are plan views of common end plate 58 and input light point reconfiguration plate 62, respectively. Input ends 78 of input bundle of light guides 60 are securely held in the central aperture of common end plate 58. The output ends 82 of input bundle of light guides 60 are reconfigured and mounted in curved or arcuate slots 80 of input light point configuration plate 62, as shown in FIG. 7. Preferably, each arcuate slot 80 is wide enough to hold the output ends of two light fibres. The length of arcuate slots 80 depends upon the particular optical effect to be created. Alternatively, some or all of the apertures in plates 62, 66 could take the form of radially extending slots or circular apertures depending upon the desired end effect.

As shown in FIG. 8, colour wheel 86 is preferably a circular disc of acetate film, created either by printing from a computer program using a QMS system or the like, or by a film process such as Cibachrome or similar film transfer process. Colour wheel 86 includes a plurality of coloured zones 87A, 87B, 87C, etc. in the shape of annular sectors of a circle, which correspond in width to arcuate slots 80, 84 to prevent light cross-over from one zone to another. Coloured zones may be of one or more colours or transparent in whole or in part. The length of colour zones 87 depends upon the duration of the desired visual effect. In the case of each annular sector 87, the portion of the annulus which is not coloured is opaque to prevent light from being transmitted through such portion.

In operation, light emitted from light 72 of light source 57 is focused by lens 74 onto common end 76 of common end plate 58. First bundle of light guides 60 then distributes this light into a multiplicity of light paths separated into a plurality of light zones created by the output ends 82 of input bundle of light guides 60 held in arcuate slots 80. Light from output ends 82 of input bundle 60 is then transmitted through colour wheel 86 and is received by input ends 84 of output bundle of light guides 68. As the input zones 80 are mirror images of output zones 84, all of the light in a particular input zone 80A is received by corresponding output zone 84A. This light is then distributed by output bundle of light guides 68 to pre-selected locations behind display panel 54. As colour wheel 86 is rotated by motor 91, various colour zones 87 periodically register with arcuate slots 80, 84, resulting in the periodic transmission of filtered light.

As the leading edge of each coloured zone 87 crosses the front end of fibre optically filled slots 80, 84, the coloured light is transmitted through such fibres to display panel 54, creating the effect of movement and flow. Different designs require different colour wheels and plates 60, 68 having an appropriate number of slots of appropriate length. A "painting with light" effect can be created by proper sequencing of the output ends of the output bundle of light guides 68 on the display panel, i.e. by placing the light fibres located in the front of the arcuate slot at the beginning of the design, such as the first letter of a word, and so on.

Different end effects can be created by varying the length of arcuate slots 80, 84 and the length of colour wheel zones 87. For example, a short burst of colour running through an effect would be produced by a short colour wheel zone and a correspondingly long slot on configuration plates 60, 68. Conversely, an area on the display panel which continuously changes colour would require a colour path or zone around the full circumference of the colour wheel 86 and a short slot on plates 60, 68.

Figure 10:
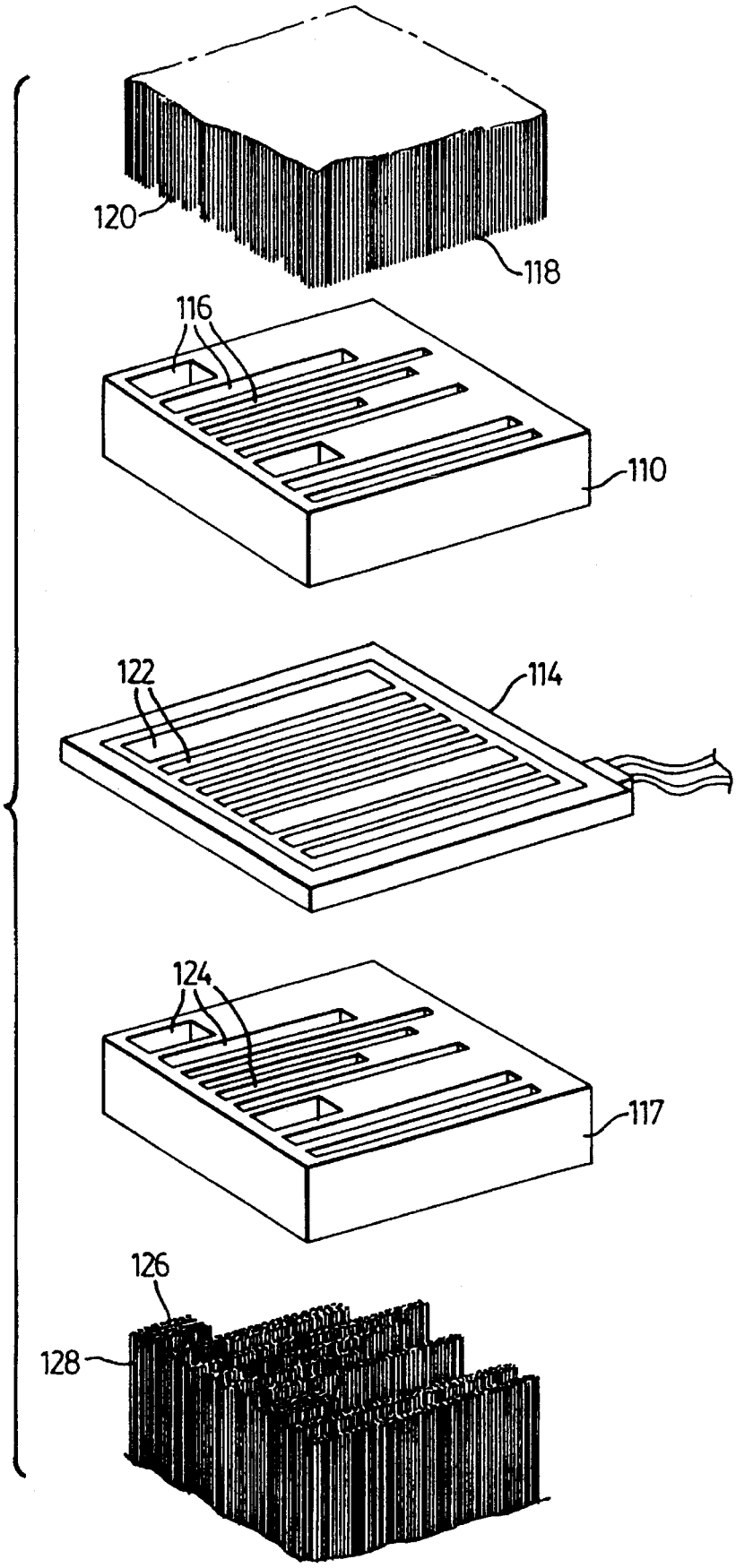
FIG. 10 is an exploded perspective view of an alternative embodiment of the subject light management apparatus.

Referring now to FIG. 10, in an alternative embodiment, the subject light processing means comprises a square input reconfiguration plate 110, liquid crystal filter 114, and square output configuration plate 117. Reconfiguration plate 110 has a series of aligned straight, elongated slots 116 of pre-selected lengths for holding the output ends 118 of input bundle of light guides 120. Liquid crystal filter 114 may be a microprocessor-controlled active or passive liquid crystal matrix having a series of linear, elongated colour zones 122 which when activated by the microprocessor periodically change colour. Output configuration plate 117 has a series of slots 124, which are preferably mirror images of slots 116, for holding input ends 126 of output light guides 128. Alternatively, while colour zones 122 and slots 116 and 124 as illustrated define a plurality of linear, elongated light paths, it should be understood that colour zones 122 could assume other shapes (e.g. circular, amorphous), in which case slots 116, 124 would be reshaped to correspond therewith. Light passing through slots 116 of input plate 110 is filtered by colour zones 122 as it passes therethrough. Preferably, when liquid crystal filter 112 is activated, colours flow across its surface in a pre-determined fashion to create the effect of painting with colour.

The processing apparatus of the subject invention makes the input light more uniform, and provides more accurate illumination of an end effects panel, particularly in the case of animation. The reconfigured light paths created by the input harness of light guides and the reconfiguration plates reduce or eliminate light cross-over from one path to another, while at the same time maximizing the amount of light transmission through the colour wheel. The subject apparatus also reduces the risk of heat damage to the colour wheel, because it is placed farther away from the light source between the two configuration plates. As a result, light weight acetate colour wheels having a full range of colour combinations, may be used and rotated with a small, low torque motor.

While the subject light processing apparatus is illustrated as processing light used to produce visual effects on a display panel such as a sign, it should be appreciated that such control apparatus can also be used in many other lighting applications, such as moving light from one spot light to another in a pre-selected pattern, and holographic and other displays.

Further, while fibre optic light guides are the presently preferred means for distributing light into a plurality of input and output paths, other types of light guides, such as water-filled tubes, could be used to so distribute the light. Likewise, a casting of light guiding material of appropriate shape having an exterior coating with a suitable refractive index for reflecting light being transmitted therethrough, could be used instead of a plurality of light guides.

Thus while what is shown and described herein constitutes various preferred and alternative embodiments of the subject invention, it will be understood that various changes can be made to such embodiments without departing from the subject invention, the scope of which is defined in the appended claims.

We claim:

1. Light processing apparatus for creating visual effects with light from a light source, comprising:

a) input light distribution means for distributing light from the light source into a plurality of input light paths, having input ends for receiving light from the light source and output ends;

b) input light path reconfiguring means for reconfiguring the output ends of the input distribution means into a plurality of separated input zones of selected shape;

c) filtering means for filtering the light emitted from the output ends of the input distribution means, having filtering areas shaped to correlate with the input zones for transmitting light of pre-selected colours;

d) filtered light distribution means for distributing the light transmitted through the filtering means into a plurality of output light paths, having input ends and output ends; and e) filtered light configuring means for configuring the input ends of the filtered light distribution means into output zones shaped to correlate with the input zones.

2. Apparatus defined in claim 1, wherein the input light distribution means comprises an input bundle of flexible light guides having input ends for receiving the light from the light source, and output ends.

3. Apparatus as defined in claim 2, wherein the filtered light distribution means comprises an output bundle of flexible light guides having input ends and output ends.

4. The apparatus defined in claim 3, wherein the input zones and output zones comprise arcuate paths.

5. The apparatus defined in claim 3, wherein the output light path configuration means comprises a plate having a series of arcuate slots therein dimensioned to securely hold the input ends of the output bundle of light guides.

6. The apparatus defined in claim 2, wherein the input light path reconfiguring means comprises a plate having a series of arcuate slots therein each dimensioned to securely hold the output ends of a portion of the input bundle of light guides.

7. The apparatus defined in claim 6, wherein the input light distribution means also comprises a common end plate having an aperture for securely holding the input ends of the input bundle of light guides.

8. The apparatus defined in claim 4, wherein the input and output zones are mirror images.

9. The apparatus defined in claim 1, wherein the filtering means comprises an active filter having filtering areas which change colour when the filter is activated.

10. The apparatus defined in claim 9, wherein the active filter comprises a rotatable circular colour wheel having coloured zones in the shape of annular sectors of a circle.

11. The apparatus defined in claim 9, wherein the active filter comprises a computer-controlled panel having coloured zones of pre-selected shapes.

12. The apparatus defined in claim 11, wherein the panel is a liquid crystal display.

13. The apparatus defined in claim 1, further comprising display means for receiving the output ends of the filtered light distribution means in a pre-selected manner so as to create pre-determined visual effects.

14. Light processing apparatus for creating visual effects with light from a light source, comprising:

a) light distribution means for distributing light from the light source into a multiplicity of light paths, comprising an input bundle of flexible fibre optic light guides having optically finished input ends for receiving the light from the light source, and optically finished output ends;

b) input light path reconfiguring means for configuring the output ends of the input light guides into a plurality of separated input zones of selected shape;

c) filtering means for filtering the light emitted from the output ends of the input bundle of light guides, having filtering areas shaped to correlate with the input zones, adapted to transmit light of pre-selected colours;

d) filtered light distribution means for distributing the light transmitted through the filter means, comprising an output bundle of flexible fibre optic light guides having optically finished input ends and output ends; and e) filtered light configuring means for configuring the input ends of the output bundle of light guides into output zones shaped to correlate with the input zones.

15. The apparatus defined in claim 14, wherein the input light path reconfiguring means comprises a plate having a series of slots therein each dimensioned to securely hold the output ends of a portion of the input bundle of light guides.

16. The apparatus defined in claim 15, wherein the input light distribution means also comprises a common end plate having an aperture for securely holding the input ends of the input bundle of light guides.

17. The apparatus defined in claim 16, wherein the output light path configuration means comprises a plate having a series of slots therein dimensioned to securely hold the input ends of the output bundle of light guides.

18. The apparatus defined in claim 17, wherein the slots are arcuate shaped.

19. The apparatus as defined in claim 17, wherein the slots are linear.

20. A visual effects sign, comprising:

a ) a housing;

b) a light source mounted in the housing;

c) input light distribution means mounted adjacent the light source for distributing light from the light source into a multiplicity of input light paths, having input ends for receiving light from the light source and output ends;

d) input light path reconfiguring means for reconfiguring the output ends of the input distribution means into a plurality of separated input zones of selected shape;

e) filtering means for filtering the light emitted from the output end of the input distribution means, having filtering areas shaped to correlate with the input zones, adapted to transmit light of pre-selected colours;

f) filtered light distribution means for distributing the light transmitted through the filter means into a multiplicity of output light paths, having input ends and output ends;

g) filtered light configuring means for configuring the input ends of the filtered light distribution means into output zones shaped to correlate with the input zones; and h) display means for receiving the output ends of the filtered light distribution means in a pre-selected pattern.

* * * * *